United States Patent [19]

Berkholtz

[11] 4,299,64

[45] Nov. 10, 198

[54] TAIL SEALING APPARATUS

[75] Inventor: Warren E. Berkholtz, Stockton, Calif.

[73] Assignee: Nelson R. Stauffer, Factoryville, Pa.

[21] Appl. No.: 174,612

[22] Filed: Aug. 1, 1980

[51] Int. Cl.[3] ..... B65C 3/12

[52] U.S. Cl. ..... 156/191; 156/361; 156/446; 242/56 R

[58] Field of Search ..... 156/361, 357, 187, 191, 156/184, 446; 242/56 R, 66

[56] References Cited

U.S. PATENT DOCUMENTS

| | | | |
|---|---|---|---|
| 3,044,532 | 7/1962 | Ghisoni | 156/361 |
| 3,134,706 | 5/1964 | Alexander | 156/357 |
| 3,162,560 | 12/1964 | Henson et al. | 156/361 |

*Primary Examiner*—David A. Simmons

*Attorney, Agent, or Firm*—Andrus, Sceales, Starke & Sawall

[57] ABSTRACT

An apparatus for sealing the tail of a wound roll of shee material. A pair of parallel rotatable rollers define a ta separation station and a tail wind-up station that ar disposed longitudinally along the length of the rollers A wound roll is positioned at the tail separating statio and rotated about its axis. Air jets mounted adjacent th rollers separate the tail from the body of the roll, an the separated tail is supported on an apron that extend laterally from the rollers. After separation of the tai rotation of the rollers is stopped and the roll with th separated tail is moved longitudinally along the roller to the wind-up station. A strip of adhesive is applied t the tail from a fixed adhesive head as the tail is move to the wind-up station. At the wind-up station the roll i rotated to wind the separated tail back onto the body o the roll.

19 Claims, 4 Drawing Figures

TAIL SEALING APPARATUS

BACKGROUND OF THE INVENTION

In the fabrication of roll products, such as paper towelling or toilet tissue, the product is initially wound in the form of a long roll or log which is subsequently cut into small rolls and packaged for shipment and sale. If the free end or tail of the roll is not securely fastened to the body of the roll, the slitting and packaging operations may not be properly performed in which event the packaging machinery may jam or excess paper from the roll may protrude from the package resulting in an unsightly appearance. On the other hand, if the tail is too tightly secured to the roll, it is difficult for the consumer to separate the tail from the body of the roll. The primary customer complaint to roll products is a tail that is too securely fastened to the body of the roll.

In the past, various types of apparatus have been utilized for sealing the tail to the roll. In the most common type of tail sealer, the long roll or log is kicked onto a pair of parallel rotatable rollers and the log is rotated while subjected to an air blast to release the tail from the body of the roll. With the tail released, a flying adhesive head moves longitudinally over the extended tail to deposit a bead of adhesive on the tail. After application of the adhesive, the roll is again rotated to wind the tail onto the roll body and the roll is then kicked laterally onto a discharge conveyor.

SUMMARY OF THE INVENTION

The invention is directed to an improved tail sealer for a wound roll product. In accordance with the invention, the apparatus includes a pair of parallel rotatable rollers that define a tail separating or release station and a tail wind-up station.

The elongated roll or log is deposited on the rollers at the tail separating station and the roll is rotated while subjected to a blast of air which serves to separate the tail from the body of the roll.

The separated tail is supported on an apron that extends laterally from the rollers and when the free edge of the tail is at a predetermined position, as sensed by a photoelectric eye, the rotation of the rollers is stopped. The roll with the separated tail is then moved longitudinally along the rollers to the wind-up station and during movement, the separated tail passes beneath an adhesive head which deposits a bead of adhesive on the extended tail. At the wind-up station the roll is again rotated to wind the separated tail back onto the roll body, and the roll can then be discharged from the rollers.

To aid in moving the roll from the tail separating station to the wind-up station, a guide bar can be associated with the apron to guide the separated tail in movement. The guide bar is supported on a pivotable arm and is movable between an inoperative and a guiding position. When in the guiding position the guide bar is spaced slightly above the apron to define a guideway through which the extended tail is moved as the roll is transported along the rollers.

The tail sealing apparatus of the invention utilizes a stationary adhesive head and this eliminates the problem of spattering of adhesive which accompanies the use of a flying or movable adhesive head, as used in the past.

The tail sealer of the invention has a faster production rate, and therefore, a greater capacity, than tail sealers as used in the past, because the tail is separated at one station and is wound up at a second station, so that th tail of one roll can be separated while a tail of a secon roll is simultaneously being wound back onto the roll.

The tail sealer of the invention is a more compact uni than those utilized in the past and as it is reduced i width it can be installed in locations where other tai sealers could not be used.

The use of a stationary glue head yields less mes from glue over-spray and thus reduces clean-up prob lems.

The rollers serve a dual function in that they not onl serve to rotate the roll, but also serve in conjunctio with a pusher mechanism to convey the roll betwee the tail separating and wind-up stations.

Other objects and advantages will appear in th course of the following description.

DESCRIPTION OF THE DRAWINGS

The drawings illustrate the best mode presently con templated of carrying out the invention.

In the drawings.

DESCRIPTION OF THE PREFERRED EMBODIMENT

Figures 1, 4:
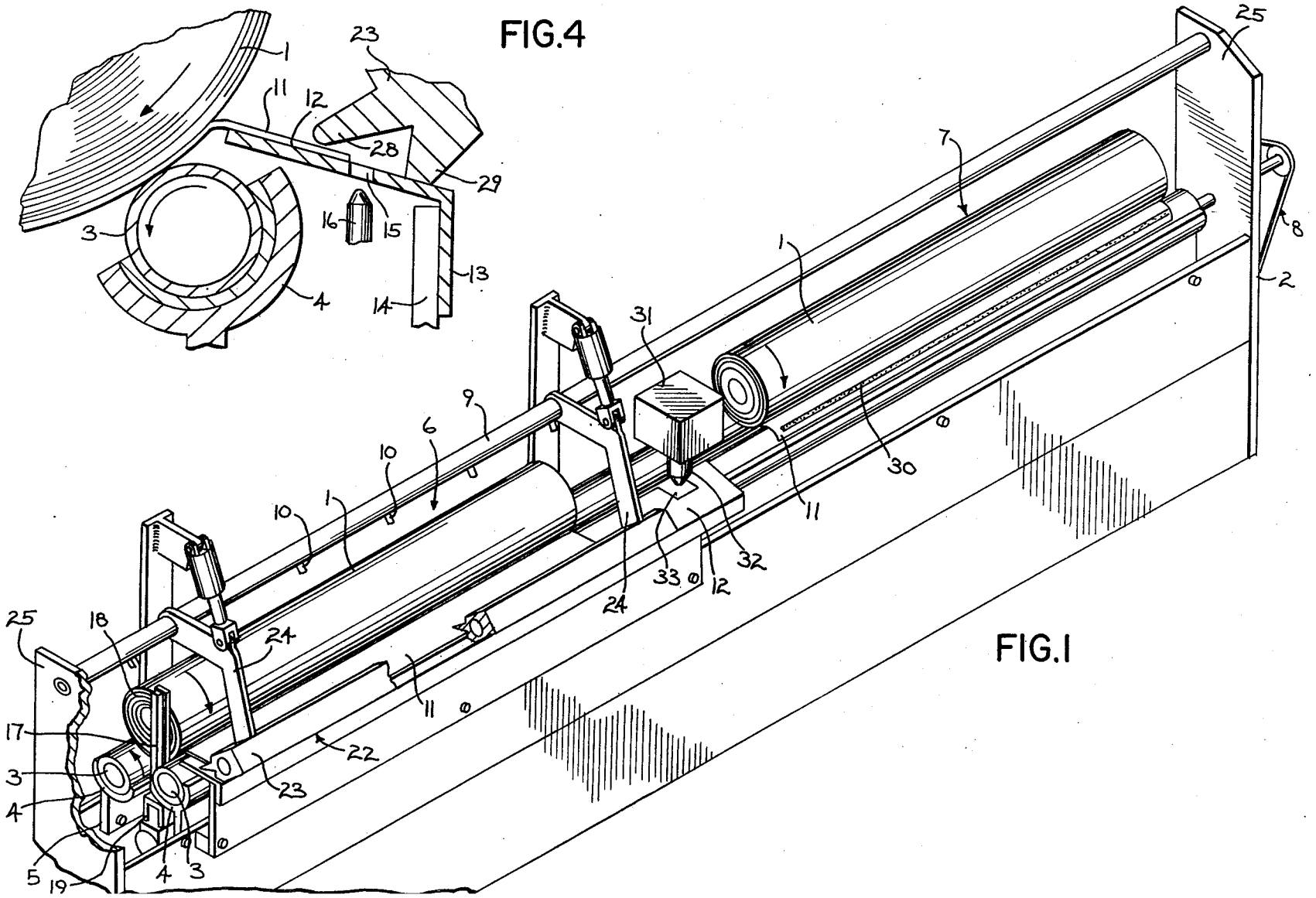
FIG. 1 is a perspective view of the tail sealing appara tus of the invention.
FIG. 4 is an enlarged fragmentary transverse sectio showing the separated tail supported on the apron.

The drawings illustrate an apparatus for sealing th free end or tail of a wound roll product 1, such as toile tissue or paper towelling. In general, the elongated ro or log has a length in the range of approximately 60 t 105 inches and has a diameter up to about 10 inches. Th apparatus can be used to seal the tail on an unsplit elor gated roll or log, or on a split log, which is cut tran versely into a series of small sections or rolls which ar in intimate contact.

The apparatus includes a frame 2 and a pair of paralle rollers 3 are mounted for rotation on the frame withi generally curved cradles 4. Cradles 4 are supported b brackets 5 from the frame 2.

Figure 3:
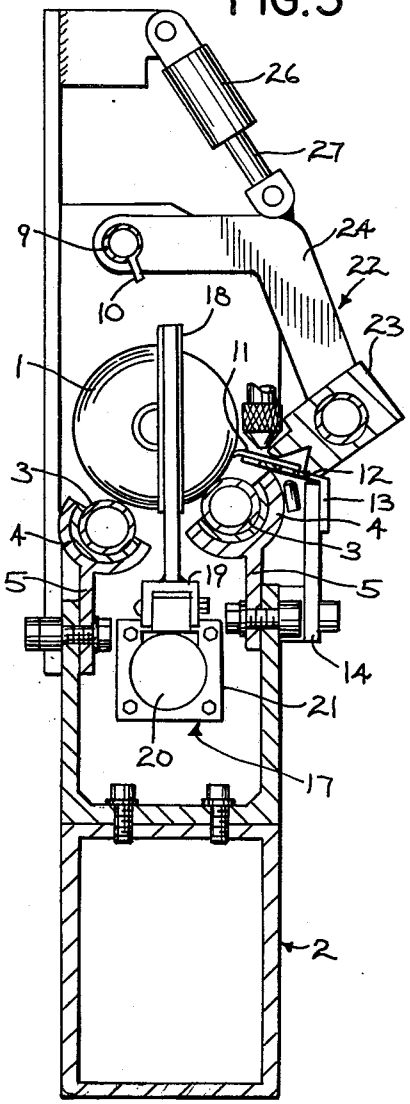
FIG. 3 is a section taken along line 3—3 of FIG. 2.
Figure 2:
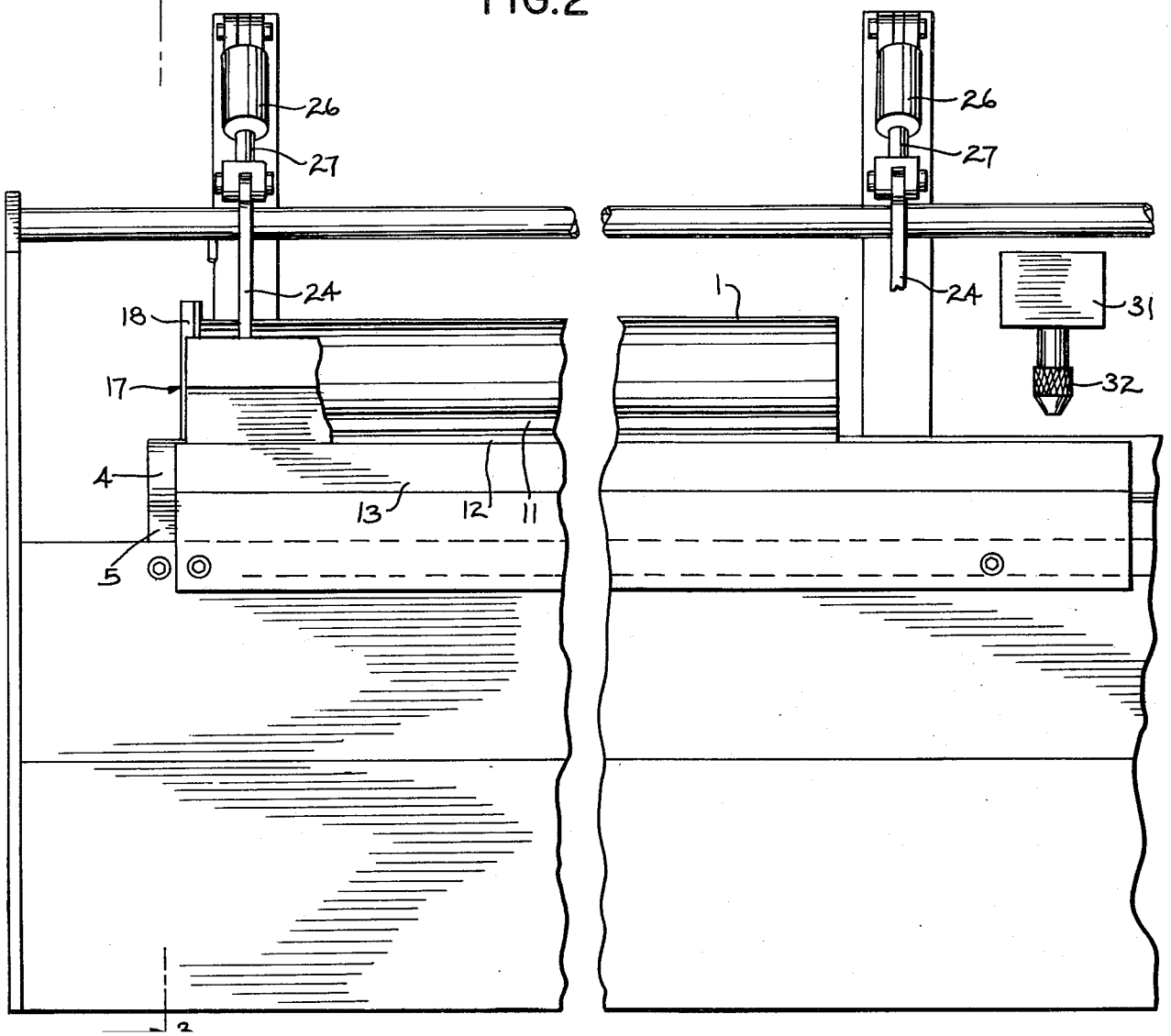
FIG. 2 is a side elevation of the tail sealing apparatu

As best illustrated in FIG. 3, rollers 3 are mounted i spaced apart parallel relation with one of the rolle being at a slightly higher elevation than the other. Th elongated roll or log 1 is introduced laterally from th side of the lowermost of the two rollers by a conve tional kicker mechanism, not shown.

The two rollers 3 define a tail separating station 6 an a wind-up station 7, and during operation, the roll 1 introduced onto the rollers at the tail separating statio 6 where the tail is separated from the roll. The roll then moved longitudinally along the rollers 3 to th wind-up station 7 where the tail, having had a bead adhesive applied thereto, is wound onto the body of th roll.

The rollers 3 are rotated in the direction of the arrow by a conventional chain drive mechanism indicate generally by 8.

In order to separate the free end or tail from th wound roll 1 as the roll is rotated at the station 6, an a blast mechanism is utilized which includes a manifold that is connected to a source of air or other gas und pressure, and the air is discharged from the manifol through a series of jets 10. The air is directed tange ially against the outer surface of the roll 1 causing the ail 11 to be moved outwardly from the roll. The reeased or separated tail 11 is supported on an apron 12 vhich extends laterally from the frame 2. As best shown 1 FIG. 3, the apron 11 is provided with a downwardly xtending flange 13 which is secured to a supporting racket 14 that in turn is connected to the frame 2.

When the tail 11 is released from the body of the roll hrough operation of the air jets 10, the free end edge of he tail will extend outwardly beyond the apron 12 and s the roll 1 continues to rotate, the tail will be drawn nwardly along the apron. The apron 12 is provided vith a hole 15 and a photoelectric eye 16 is mounted eneath the apron in alignment with the hole 15. When he free edge of the tail 11 passes across the beam of the hotoelectric eye 16, a signal is sent to the drive mechaism 8 to stop rotation of the rollers 3.

The roll with the separated tail is then moved longitulinally along the rollers 3 to the wind-up station by a usher assembly 17. Pusher assembly 17 includes a genrally vertical pusher 18 which is mounted at the end of he tail separating station and extends vertically beween the rollers 3. The lower end of the pusher 18 is onnected to a clevis 19 which is mounted on the end of ram 20 that is movable within cylinder 21. Fluid is dapted to be introduced into opposite ends of the cylinler 21. By introducing the fluid into one end of the ylinder, the pusher 18 will engage the end of the roll 1, noving the roll longitudinally along the rollers 3 to the vind-up station 7. Introducing fluid into the opposite nd of the cylinder will extend the ram 20 and return he pusher 18 to its original position.

The pusher 18 in some installations may be fixed to he clevis 19, in which case the pusher must be returned o its original position before a new roll 1 is introduced o the tail separating station 6. Alternately, the pusher an be pivoted to the clevis 19 and in this case, the usher will pivot downwardly as it is moved in its reurn stroke when it engages a fresh roll located at the ail separating station 6. When the pusher has returned o its original position a spring biasing mechanism will eturn the pusher to its upright position adjacent the end f the roll, as shown in FIG. 3. It is also contemplated hat the pusher can take the form of a flighted or cleated hain conveyor in which the cleats will engage and nove the roll to the wind-up station.

To guide the extended tail 11, which is supported on he apron 12, as the roll 1 is moved from the tail separatng station 6 to the wind-up station 7, a guide bar assemly 22 is utilized. The guide bar assembly 22 has particuar use when sealing split rolls, in which the extended ail 11 is split or cut at spaced intervals along the length f the roll. The guide bar assembly 22 includes an elongated bar 23 which is generally parallel to one of the ollers 3 and extends the entire length of the apron 12. Bar 23 is carried by a pair of arms 24 which are pivoted o the air manifold pipe 9 that extends between the side nembers 25 of the frame.

The bar 23 is adapted to be pivoted between a guiding osition, as shown in FIG. 3 and a released position. To ivot the bar 23, cylinders 26 are pivotally connected to he frame 2, and the piston rod 27 of each cylinder is ttached to the respective arms 24. Fluid is adapted to e introduced into the opposite ends of the cylinders to xtend and retract the piston rods. By extending the iston rods 27, the bar 23 will be moved to the guiding osition, while retracting the piston rods will cause the ar to move to the inoperative or release position.

As shown in FIG. 4, bar 23 is provided with an elongated projection 28, which, when the bar is in the guiding position, is spaced slightly above the apron 12 and the tail 11 is located within the space or guideway between the projection 28 and the apron 12. In addition to the projection 28, the bar 23 is also provided with an elongated stop 29 which is adapted to engage the outer edge of the apron 12 and thereby position the projection 31 in spaced relation to the apron 12. With the guide bar 23 in the guiding position, the roll can be moved from the tail separating station 6 to the wind-up station 7 with the tail moving in the guideway defined by the projection 28 and the apron 12. By guiding the extended tail, flutter of the split sections of the tail is prevented.

As the roll is moved from the tail separating station 6 to the wind-up station 7 by the pusher assembly 17, a strip of adhesive 30 is applied to the extended tail 11 by a fixed adhesive head 31. Head 31 is mounted from the frame 2 adjacent the downstream end of apron 12 and is provided with a downwardly extending nozzle 32 through which the adhesive is sprayed under relatively high pressure of about 100 psi onto the extended tail as the tail moves beneath the head. The end of apron 12 is provided with an opening or notch 33 aligned with nozzle 32, and if for some reason, the tail of the roll is not extended as the roll is pushed from station 6 to station 7, or if the roll had not been positioned at the tail separating station 6, the adhesive will merely pass through the opening 33 to a disposal container and will not contact the apron 12 thereby preventing the tail of a succeeding roll from being contaminated with the adhesive on the apron.

In operation, the elongated roll or log 1 either split transversely, or not split, is kicked onto the rollers 3 by a conventional kicker assembly, not shown. The rollers 3 are then rotated to rotate the roll about its axis and air is discharged under high pressure through jets 10 against the surface of the rotating roll causing the free end or tail 11 of the roll to separate from the body of the roll. The separated tail will engage the apron 12, and as the roll continues to rotate, the tail will be drawn inwardly along the apron. When the free edge of the tail contacts the beam of the photoelectric eye 16, a signal is generated to stop rotation of the rollers 3.

At this time, if slit rolls are employed, the guide bar 23 is pivoted downwardly into guiding position above the extended tail supported on apron 12.

The pusher assembly 17 is then actuated causing the pusher 18 to engage the end of the roll and move the roll longitudinally over the rollers 3 to the wind-up station 7. The extended tail is guided during this movement in the guideway defined by the projection 28 and the apron 12.

As the roll is moved from the tail separating station 6 to the wind-up station 7, the adhesive is supplied through the head 31 to spray a layer or strip of adhesive along the tail 11 as it is moved beneath the head. The apron 12 terminates upstream of the adhesive head 31, and as the tail 11 moves past the head 31, the tail will be unsupported and drape downwardly over one of the rollers 3. The adhesive will normally penetrate the paper material of the tail, and as the tail is unsupported after application of the adhesive, the adhesive penetrating through the tail will not contaminate the equipment.

When the roll 1 reaches the wind-up station 7, the pusher assembly 17 is retracted causing the paddle 18 to move to its original position. Guide bar 23 is moved upwardly out of the guiding position and a second or fresh roll 1 is introduced to the tail separating station 6. The rollers 3 are then rotated causing the rolls at both stations 6 and 7 to rotate. Rotation of the roll at wind-up station 7 will act to wind the extended tail 11 onto the body of the roll, while rotation of the roll at station 6, along with operation of the air blast mechanism, will result in separation of the tail in the manner previously described. The roll at station 7 is then kicked laterally from the rollers 3 onto a discharge conveyor by a suitable kicker assembly, not shown.

The tail sealing apparatus of the invention has a faster cycle time than conventional tail sealers in which the tail is separated, adhesive is applied, and the roll is rewound at a single station. With the invention, the tail of one log is separated at one station while the glued tail of a previous roll is wound simultaneously at a second station. The two-station concept substantially increases the capacity of the tail sealer over single station types.

The rollers 3 provide a dual function in that they serve to rotate the roll for tail separation and wind-up and also serve as a guide in conveying the roll between the tail separating station 6 and the wind-up station 7. The guide bar 23 defines a guideway with the apron 12 retaining the extended tail and preventing flutter, as the roll is moved to the wind-up station.

The fixed adhesive head aids in sealing two-ply or multi-ply materials and there is no spatter of adhesive as can occur with a flying or movable adhesive head. Furthermore, in the event a log, for some reason, is not positioned at the tail separating station 6, or for some reason the tail is not extended, the adhesive discharged from the head during the automatic cycle will not contact the apron, but instead will pass through the opening in the apron, thereby preventing contamination of the equipment in the event of a malfunction.

Various modes of carrying out the invention are contemplated as being within the scope of the following claims particularly pointing out and distinctly claiming the subject matter which is regarded as the invention.

I claim:

1. An apparatus for sealing the tail of a roll product, comprising a supporting structure defining a tail separating station and a separate tail wind-up station, said supporting structure including a pair of generally parallel rollers that define said tail separating station and said tail wind-up station, said stations being disposed longitudinally of said rollers, means for rotating a roll about its axis at the tail separating station, tail separating means disposed at the tail separating station for separating the tail from the body of the roll as the roll is rotated, an apron disposed laterally of the tail separating station to support the separated tail, conveying means for moving the roll with the separated tail from the tail separating station to the wind-up station, fixed adhesive supply means mounted at a level above the apron for applying an adhesive to the separated tail as the roll is moved from the tail separating station to the wind-up station, and means for rotating the roll at the wind-up station and re-winding the tail onto the body of the roll.

2. The apparatus of claim 1, wherein said conveying means comprises a pusher disposed to engage the end of the roll and move the roll longitudinally of the rollers.

3. An apparatus for sealing the tail of a roll product, comprising a pair of generally parallel supporting rollers defining a tail separating station to receive a roll and separate the tail from the body of the roll and a wind-up station to rewind the tail on the roll, said stations being disposed longitudinally of each other, rotating means for rotating the rollers to rotate the roll about its a tail separating means disposed at the tail separat station for separating the tail from the body of the r as the roll is rotated, an apron disposed laterally of c of the rollers to support the separated tail, convey means for moving the roll on said supporting roll from the tail separating station to the wind-up stati and fixed adhesive supply means mounted adjacent apron for applying an adhesive to the separated tail the roll is moved from the tail separating station to wind-up station, said rotating means acting to rotate roll at the wind-up station to rewind the separated onto the body of the roll.

4. The apparatus of claim 3, wherein said conveyi means comprises a pusher disposed to engage the end the roll and move the roll longitudinally of the rolle

5. The apparatus of claim 4, wherein said pusl extends upwardly between said rollers.

6. The apparatus of claim 5, and including dri means disposed beneath the rollers and connected said pusher.

7. The apparatus of claim 3, wherein said tail separ ing means comprises a plurality of fluid jets disposed direct a gaseous fluid generally tangentially to the r to separate the tail from the body of the roll.

8. The apparatus of claim 3, and including a gui member movable between a guiding position and non-guiding position, said guide member when in t guiding position being spaced from the apron to provi a guideway, said separated tail being movable witl said guideway as the roll is moved from the tail separ ing station to the wind-up station.

9. The apparatus of claim 8, and including means moving the guide member between the guiding positi and the non-guiding position.

10. The apparatus of claim 8, wherein said gui member extends longitudinally the length of the apr

11. The apparatus of claim 3, and including sensi means responsive to the free edge of the separated t being disposed at a predetermined position on the apr for stopping operation of the rotating means to st rotation of the rollers, whereby the roll can then moved longitudinally on the rollers by said conveyi means.

12. The apparatus of claim 3, wherein said adhesi supply means is disposed above said apron and sa apron is provided with an opening aligned with sa adhesive supply means, whereby said adhesive will pa through said opening and not contact the apron in t event a separated tail is not on the apron when t adhesive supply means is operated.

13. A method of sealing a tail of a roll product co prising the steps of positioning a roll at a first static rotating the roll at said first station, separating the t from the body of the rotating roll, stopping rotation the roll, supporting the separated tail on a support me ber, positioning a guide member in spaced relation said support member to provide a guideway, movi the roll with the separated tail longitudinally to a se ond station, moving the separated tail within the guic way as the roll is moved to said second station, applyi an adhesive to the separated tail as the roll is mov from the first station to the second station, and rotati the roll at the second station to rewind the tail onto t body of the roll.

14. The method of claim 13, wherein the step of sep rating the tail comprises discharging a gas tangential gainst the surface of the rotating roll to separate the il from the body of the roll.

15. The method of claim 13, and including the step of nsing the position of the free edge of the separated il, and stopping rotation of the roll when the free edge at a predetermined position with respect to the body f the roll.

16. The method of claim 13, wherein the step of mov- ıg the roll comprises engaging the end of the roll with movable member, and moving the movable member om a first position to a second position to move the ɔll from the first station to the second station.

17. A method of sealing the tail of a roll product, ɔmprising, the steps of forming a roll supporting struc- ıre by positioning a pair of rollers in generally parallel elation, one end of said supporting structure defining a rst tail separating station and the opposite end of said ıpporting structure defining a second wind-up station, ositioning a roll product at the first station, rotating at east one of the rollers to rotate the roll about its axis, separating the tail from the body of the rotating roll, stopping rotation of the roll, moving the roll with the separated tail longitudinally along said rollers from the first station to said second station, applying an adhesive to the separated tail as the roll is moved from the first station to the second station, and rotating the roll at the second station to rewind the tail onto the body of the roll.

18. The method of claim 17, and including the step of supporting the separated tail on a support member, and moving the separated tail along the support member as the roll is moved from the first station to the second station.

19. The method of claim 17, and including the step of positioning a guide member in spaced relation to the support member to provide a guideway, and moving the separated tail within the guideway as the roll is moved from the first station to the second station.

* * * * *